US008876676B2

(12) United States Patent
Lalaoua

(10) Patent No.: US 8,876,676 B2
(45) Date of Patent: Nov. 4, 2014

(54) PORTABLE FITNESS CHAIR

(75) Inventor: Nabile Lalaoua, Las Vegas, NV (US)

(73) Assignee: Nabile Innovations LLC, Las Vegas, NV (US)

( * ) Notice: Subject to any disclaimer, the term of this patent is extended or adjusted under 35 U.S.C. 154(b) by 453 days.

(21) Appl. No.: 13/331,762

(22) Filed: Dec. 20, 2011

(65) Prior Publication Data

US 2013/0157818 A1 Jun. 20, 2013

(51) Int. Cl.
*A63B 21/02* (2006.01)
*A63B 21/04* (2006.01)
*A63B 21/00* (2006.01)

(52) U.S. Cl.
USPC ..... 482/126; 482/123; 482/125; 482/130; 482/133

(58) Field of Classification Search
CPC ..... A63B 2210/02; A63B 2210/50
USPC ..... 482/72, 95, 121–126, 129–131, 482/133–138, 142, 904
See application file for complete search history.

(56) References Cited

U.S. PATENT DOCUMENTS

| | | | | |
|---|---|---|---|---|
| 4,838,547 | A | 6/1989 | Sterling | |
| 4,921,247 | A | 5/1990 | Sterling | |
| 5,002,271 | A | 3/1991 | Gonzales | |
| 5,044,633 | A | 9/1991 | Rice | |
| 5,090,694 | A | 2/1992 | Pauls et al. | |
| 5,324,243 | A | 6/1994 | Wilkinson | |
| 5,833,582 | A * | 11/1998 | Chen | 482/57 |
| 6,013,014 | A | 1/2000 | Hern | |
| 6,063,012 | A | 5/2000 | Berkowitz et al. | |
| 6,117,056 | A | 9/2000 | Cataldi, Jr. et al. | |
| 6,146,317 | A | 11/2000 | Prusick | |
| 6,220,995 | B1 * | 4/2001 | Chen | 482/140 |
| 6,312,366 | B1 | 11/2001 | Prusick | |
| 6,461,283 | B1 | 10/2002 | Maron | |
| 6,500,010 | B2 | 12/2002 | Yatskov | |
| 6,500,104 | B1 | 12/2002 | Rich | |
| 6,547,705 | B2 | 4/2003 | Yu | |
| 6,755,463 | B2 | 6/2004 | Lardieri et al. | |
| 6,979,284 | B2 | 12/2005 | Curtis | |
| 7,077,792 | B2 | 7/2006 | Nerenberg | |
| 7,322,907 | B2 * | 1/2008 | Bowser | 482/121 |
| 7,361,127 | B2 | 4/2008 | Tremayne | |
| 7,374,518 | B2 | 5/2008 | Ratner | |
| 7,381,168 | B2 | 6/2008 | Bowser | |
| 7,611,450 | B2 | 11/2009 | Mancini | |
| 7,621,852 | B2 | 11/2009 | Bowser | |
| 7,794,378 | B2 * | 9/2010 | Splane et al. | 482/142 |

(Continued)

FOREIGN PATENT DOCUMENTS

| | | |
|---|---|---|
| DE | 202006000913 | 3/2006 |
| DE | 202007003177 | 8/2007 |
| WO | WO 2007/148333 | 12/2007 |

*Primary Examiner* — Loan H Thanh
*Assistant Examiner* — Jennifer M Deichl
(74) *Attorney, Agent, or Firm* — Notaro, Michalos & Zaccaria P.C.

(57) ABSTRACT

A portable exercise chair that includes a chair frame, a chair seat and a resistance system. The resistance system includes first and second resistance arrangements. Each of the resistance arrangements includes first and second resistance hubs and a stretchable resistance member. The resistance hubs on the first and second resistance arrangements are releasably and swivelly connected to the chair frame. The resistance system is designed to enable a user to perform a variety of exercises. The portable exercise chair can include a retractable foot plate.

13 Claims, 12 Drawing Sheets

(56) References Cited

U.S. PATENT DOCUMENTS

| | | | | |
|---|---|---|---|---|
| 7,803,096 | B2 * | 9/2010 | Mehta | 482/140 |
| 7,998,042 | B2 | 8/2011 | Bowser et al. | |
| 2004/0152572 | A1 | 8/2004 | Reitz et al. | |
| 2005/0187080 | A1 | 8/2005 | Bowser | |
| 2006/0054397 | A1 | 3/2006 | Pringnitz | |
| 2008/0039301 | A1 | 2/2008 | Halbridge | |
| 2008/0214371 | A1 | 9/2008 | Alexander | |
| 2008/0287269 | A1 | 11/2008 | Humble et al. | |
| 2009/0233773 | A1 | 9/2009 | Cardey | |
| 2010/0041526 | A1 | 2/2010 | Bowser et al. | |
| 2010/0255965 | A1 * | 10/2010 | Chen | 482/130 |

* cited by examiner

PORTABLE FITNESS CHAIR

The present invention is directed to an exercise device, more particularly to an exercise device that utilizes resistance cables that connect to a chair, and even more particularly to an exercise device in the form of a folding chair that includes one or more resistance cables that are connected to the chair and enables a user to preformed different types of exercises when using the chair.

BACKGROUND OF THE INVENTION

The busy life led by individuals often interferes with the time needed for exercise. A sedentary lifestyle, especially at work, contributes to the problem of a general lack of fitness for many. Many elderly, disabled and/or handicapped individuals can also find it difficult to regularly exercise. As such, there is a need for an exercise device that can enable a user to perform a variety of exercises while seated in a chair or positioned near a chair, such as in an office chair. The exercise device should not be a hindrance when not in use. The exercise device should provide for stomach contraction, antagonist exercise, and a variety of other exercises.

The use of resistance cables for exercising is well known in the prior art. There are many different exercise systems that have been use to address the increased demand for physical fitness. Many of these exercise devices use resistance cables or other types of resistance systems. Non-limiting examples of such devices are disclosed in U.S. Pat. Nos. 7,998,042; 7,621,852; 7,611,450; 7,361,127; 7,381,168; 7,374,518; 7,322,907; 7,077,792; 6,979,284; 6,547,705; 6,500,010; 6,461,283; 6,312,366; 6,146,317; 6,117,056; 6,063,012; 6,013,014; 5,324,243; 5,090,694; 5,044,633; 5,002,271; 4,921,247; 4,838,547; US 2009/0233773; US 2008/0214371; US 2008/0039301; US 2005/0187080; and US 2004/0152572, and references cited therein, all of which are incorporated herein by reference.

For example, U.S. Pat. No. 6,312,366 discloses a bar for attachment onto the back support of a chair. This device allows for limited in exercises. U.S. Pat. No. 6,063,012 discloses an exercise device for wrap-around attachment to a chair back. The device interferes with a person seated in the chair when not in use. U.S. Pat. No. 6,013,014 discloses a curved plate device for attachment about a couch back. This device cannot be used with a personal chair, such as an office chair.

While many of the above identified exercise devices fulfill their respective and particular objects and requirements, such prior art does not disclose a multi-exercise apparatus for chair base attachment.

Although, there are many chair exercising devices, many of these devices are heavy and/or complicated fitness equipment. Many of the prior art devices do not offer an exercise attachment arrangement to a personal chair, such as an office chair, or does not provide an exercise arrangement having versatility and not be an intrusive attachment to the chair. There remains a need for a light weight, portable and compact fitness machine with multiple functions to perform a full body workout while in a seating or standing position, and which exercise system is easy and convenient to use, and can be fold up quick and easy storage. There also remains a need for an improved multi-exercise apparatus for chair base attachment.

SUMMARY OF THE INVENTION

The present invention is directed to a portable exercise device that overcome the past limitations of prior portable exercise devices. The portable exercise device in accordance with the present invention includes the use of one or more resistance cables that are connected to a chair, such as a folding chair, to enable a user to preformed different types of exercises when sitting in the chair or standing next to the chair.

In one non-limiting aspect of the present invention, there is provided an improved exercise chair. The exercise chair includes a frame, a seat connected to the frame, and a resistance system. The exercise chair can also include one or more foot rests connected to the frame; however, this is not required. The size, shape and materials used to form the exercise chair are non-limiting. In one non-limiting embodiment of the invention, the exercise chair is foldable; however, this is not required. In another and/or alternative non-limiting embodiment of the invention, the exercise chair includes one or more wheels or rollers to facilitate in the movement of the exercise chair; however, this is not required. In still another and/or alternative non-limiting embodiment of the invention, the exercise chair includes a foldable seat that can fold up and/or down when the frame of the exercise chair is folded; however, this is not required. In yet another and/or alternative non-limiting embodiment of the invention, the seat of the exercise chair includes can include padding (e.g., foam, feathers, filling, etc.) and/or be formed of a soft, flexible and/or compressible material to facilitate in the comfort of the user when sitting on the seat of the exercise chair; however, this is not required. In still yet another and/or alternative non-limiting embodiment of the invention, the frame of the exercise chair includes a back portion that provides back support to a user when sitting in the exercise chair; however, this is not required. The back support, when used, can optionally include one or more padded surfaces and/or one or more surfaces that are formed of a soft, flexible and/or compressible material to facilitate in the comfort of the user and/or to provide back support to the user when sitting on the seat of the exercise chair. The back support, when used, can also or alternatively be used as a gasping surface to provide support to a user when standing next to the exercise chair; however, this is not required. In another and/or alternative non-limiting embodiment of the invention, the foot rest can be used to provide stability to the exercise chair when the user is exercising while seated in the exercise chair and/or standing near the seat of the exercising chair; however, this is not required. In still another and/or alternative non-limiting embodiment of the invention, the resistance system is partially or fully connected to the frame, the seat and/or the at least one foot rest of the exercise chair. In yet another and/or alternative non-limiting embodiment of the invention, the resistance system includes one or more stretchable cords (e.g., bungee or stock cord, etc.), one or more springs (e.g., gas spring, mechanical coil spring, etc.), one or more pieces of flexible memory materials (e.g., metal material, fiberglass material, composite material, plastic material, etc.), and/or one or more pieces of stretchable memory materials (e.g., rubber cord or band, synthetic rubber cord or band). In one non-limiting arrangement, the resistance system includes one, two, three, four, five, or six or more stretchable cords. In one particular design, the user, can select the number of stretchable cords to be used when performing one or more exercises; however, this is not required. In yet another and/or alternative non-limiting embodiment of the invention, the resistance system can be partially or fully detachably connected to the frame, the seat and/or the at least one foot rest of the exercise chair. In one non-limiting arrangement, the resistance system includes a resistance arrangement positioned on one or both sides of the chair. In such an configuration, The frame of the chair can include one, two, or three connection locations for the resistance arrangement for each side of the chair that the resistance arrangement is located; however, this is not required.

In another and/or alternative non-limiting aspect of the present invention, there is provided an improved exercise chair that enables a user of the exercise chair to easily and conveniently perform a plurality of different exercises so as to exercise one or more portions of a users body. Non-limiting exercises that can be conducted on the exercise chair include: 1) abdominal exercises, back exercises, leg exercises, arm exercises, neck exercises, foot and angle exercises, hand and wrist exercises, etc. These exercises can be used to exercises a variety of muscles in the user body (e.g., Stomach (i.e., abdominal, oblique, etc.), Arms (i.e., biceps, triceps, flexor carpi radials, palmaris longus, extensor digitorum, brachioradialis, etc.), Hands, Feet, Chest (i.e., pectoralis major, latissimus dorsi, etc.), Shoulders (i.e., anterior deltoid, middle deltoid, etc.), Back (i.e., latissimus dorsi, teres major, rear deltoid, etc.), Neck (i.e., middle and lower trapezius, platysma, etc.), and Legs (i.e., gluteus maximus, satorius, vastus medialis, vastus lateralis, rectus femoris, gastrocnemius muscle, etc.). The exercises can be used for generally exercising, weight loss, muscle toning, rehabilitation, etc. The exercise chair is designed to enable a user to sit in the exercise chair and to perform one or more types of exercises. The exercise chair can also be designed to enable a user to stand and/or knell at the front and/or rear of the chair and perform one or more types of exercises; however, this is not required.

In still another and/or alternative non-limiting aspect of the present invention, the exercise chair includes a frame that includes a lower or base portion and an upper back portion. The lower or base portion of the frame can have a variety of configurations. One non-limiting configuration is that the lower or base portion is formed of four legs (e.g., two front legs and two rear legs, etc.) and the seat is connected or interconnected to a plurality of the legs. Another non-limiting configuration is that the lower or base portion is formed of a vertical post (e.g., gas cylinder, post, etc.) that is connected the chair seat and to a base that has a plurality of legs which can include a wheel, roller or the like. As can be appreciated, the lower or base portion of the exercise chair can have other configurations. The upper back portion of the exercise chair can also have a variety of configurations. The upper back portion includes a back support that extends upwardly from the seat to support the back of a user while the user is sitting on the seat. One non-limiting configuration is that the upper back portion is formed of two bars or posts and a one or more back plates, back bars, mesh or fabric material, etc. is connected to and positioned between the two bars or posts. When the exercise chair includes two front legs, the front legs and the two bars or posts can be a single piece of material (e.g., tubular metal, composite, material, etc.) and/or van be connected together; however, this is not required. The resistance system is designed to be connected to a both the lower or base portion and the upper back portion. The resistance system can be designed to be removably or irremovably connected to either or both the lower or base portion and the upper back portion.

In yet another and/or alternative non-limiting aspect of the present invention, the exercise chair includes a foldable frame; however, this is not required. The foldable frame includes four folding chair legs that can pivot to fold either under the seat, or at the seat. The seat can be designed to pivot at the seat level. In such an arrangement, the seat aligns between back supports wherein the back support and the front legs are the same part or form the same continuous part.

In still yet another and/or alternative non-limiting aspect of the present invention, resistance system used on the exercise chair is designed to be detachably connected to both the lower or base portion and the upper back portion of the exercise chair. In one non-limiting arrangement, the resistance system is detachably connected to both the front region of the lower or base portion (e.g., front legs, etc.) and the upper back portion of the exercise chair; however, this is not required. In another and/or alternative non-limiting arrangement, the resistance system is detachably connected to both the rear region of the lower or base portion (e.g., rear legs, etc.) and the upper back portion of the exercise chair; however, this is not required. In still another and/or alternative non-limiting arrangement, the resistance system can be detachably connected to either the front and rear region of the lower or base portion (e.g., front or rear legs, etc.) and the upper back portion of the exercise chair; however, this is not required. In this arrangement, the resistance system has the ability to connect to resistance system and to either to the front and rear region of the lower or base portion, thus expanding the versatility of the exercise chair. For some exercises, the resistance system may need to be connect to both the front region of the lower or base portion and the upper back portion. For other types of exercises, the resistance system may need to be connect to both the rear region of the lower or base portion and the upper back portion. The exercise chair can be designed to enable both types of setups; however, this is not required. The lower or base portion and the upper back portion of the exercise chair include resistance connectors that are designed to connect to a portion of the resistance system. In one non-limiting embodiment, the resistance connectors the lower or base portion and the upper back portion of the exercise chair have a similar configuration so that the resistance system can be easily connected to the frame of the exercise chair; however, this is not required. The resistance system can include connectors that can be designed to connect to either of the resistance connectors the lower or base portion and the upper back portion of the exercise chair; however, this is not required. In another and/or alternative non-limiting embodiment, the resistance system includes a first and second resistance hubs (e.g., pulley arrangement, guide arrangement, mounting arrangement, etc.) and one or more resistance cords or bands that are connected to the first and second resistance hubs. The first and second resistance hubs are designed to be the connectors of the resistance system, thus the first and second resistance hubs are designed to be connect to the resistance connectors on the lower or base portion and the upper back portion of the exercise chair. The first and second resistance hubs can have an arrangement to connect to the resistance connectors on the lower or base portion and the upper back portion so that the first and second resistance hubs can be connected to the resistance connectors on either the lower or base portion and the upper back portion; however, this is not required. The first and/or second resistance hubs can have a low friction arrangement (e.g., rollers, smooth surfaces, etc.) to facilitate in the movement of one or more resistance cords or bands partially or fully through the first and/or second resistance hubs; however, this is not required. The first and/or second resistance hubs can have a guide arrangement (e.g., hole, grooved roller, etc.) to maintain the position of the one or more resistance cords or bands as the one or more resistance cords or bands partially or fully move through the first and/or second resistance hubs; however, this is not required. The first and/or second resistance hubs can have an arrangement to connect to the resistance connectors on the lower or base portion and/or the upper back portion so that the first and second resistance hubs can rotate or swivel relative to the lower or base portion and/or the upper back portion (e.g., 45° swivel, 90° swivel, 135° swivel, 180° swivel, 225° swivel, 270° swivel, 360° swivel, etc.); however, this is not required. The one or more resistance cords or bands can include an attachment arrangement to enable different types of user mechanisms (e.g., handle, Velcro band, etc.) to be removably or irremovably connected to one or both ends of the one or more resistance cords or bands; however, this is not required. In one non-limiting arrangement, each set of hubs is designed for use with a single resistance cord or band. In another non-limiting arrangement, each set of hubs is designed for use with a one or two resistance cords or bands. In still another non-limiting arrangement, each set of hubs is designed for use with a one, two or three resistance cords or bands. In still another non-limiting arrangement, each set of hubs is designed for use with a one, two, three, four or more resistance cords or bands. The force required to stretch the one or two resistance cords or bands is non-limiting. When two or more resistance cords or bands are used, the force required to stretch each of the resistance cords or bands can be the same or different. In still another and/or alternative non-limiting embodiment, the resistance system includes a first, second and third resistance hubs and one or more resistance cords or bands that are connected to the first and second resistance hubs and a guided by the third resistant hub; however, this is not required. The first and second resistance hubs can have an arrangement to connect to the resistance connectors on the lower or base portion and the upper back portion; however, this is not required. The third resistance hub is designed to be connected to the seat and/or on the frame at a location that is at or near the seat; however, this is not required. The third resistance hub can be removably or irremovably connected to the frame and/or seat. The third resistance hub can be designed to swivel relative to the frame and/or seat; however, this is not required. The configuration and/or features of the third resistance hub can be the same or similar to one or more configurations and/or features of the first and second resistance hub; however, this is not required.

In another and/or alternative non-limiting aspect of the present invention, the exercise chair includes at least one foot rest that is connected to the frame. In one non-limiting embodiment, the foot rest is connected to the front region of the lower or base portion (e.g., front legs, etc.); however, this is not required. In another and/or alternative non-limiting arrangement, the foot rest is connected to the rear region of the lower or base portion (e.g., rear legs, etc.); however, this is not required. In still another and/or alternative non-limiting arrangement, one foot rest is connected to the front region of the lower or base portion and another foot rest is connected to the rear region of the lower or base portion of the exercise chair. In another and/or alternative non-limiting embodiment, the foot rest moves or otherwise folds up when the frame of the exercise chair is folded up; however, this is not required. In such an arrangement, a movement connector connected between the seat and the foot rest can be used to cause the foot rest to moves or otherwise folds up when the frame of the exercise chair is folded up; however, this is not required. As can be appreciated, other or additional arrangements can be used to cause the foot rest to moves or otherwise folds up when the frame of the exercise chair is folded up. In still another and/or alternative non-limiting embodiment, the top surface of the foot rest can include a gripping surface (e.g., rough surface, gripping polymer surface, rubber surface, etc.) to facilitate in the user maintaining contact and/or reduce slippage while the user is in contact (e.g., feet, shoes, etc. positioned on the food rest, etc.) with the foot rest; however, this is not required. The foot rest is generally mounted to the frame of the exercise chair. Such an arrangement can provides stability to the exercise chair when a user is using the chair; however, this is not required. For instance, when a user stands on the foot rest and the foot rest is connected to the frame of the exercise chair, the weight of the user on the foot rest can facilitate in anchoring the chair to a floor surface or otherwise limit or prevent movement of the frame while the user is performing exercises in conjunction with the exercise chair.

In still another and/or alternative non-limiting aspect of the present invention, frame of the exercise chair includes one or more rollers or wheels to facilitate in the movement of the exercise chair. In one non-limiting embodiment of the invention, one or more rollers or wheels are mounted to the frame so as to be elevated from a floor surface when the exercise chair is in the open or unfolded position. Such as arrangement limits or prevents the one or more rollers or wheels to cause undesired movement of the frame on a floor surface during use of the exercise chair by a user. In one arrangement, the exercise chair requires the user the tilt the chair to enable the one or more rollers or wheels to contact a floor surface; however, this is not required.

In yet another and/or alternative non-limiting aspect of the present invention, the seat is designed to swivel and/or a swivel attachment can be removably or irremovably connected to the seat; however, this is not required. The swivel seat or swivel seat attachment can be used by the user to twist in the exercise chair and thus perform additional types of exercises. When the swivel attachment is removable from the seat or the swivel seat is removable from the frame, the swivel seat or swivel seat attachment can be placed on the floor and the user can stand on the swivel seat or swivel seat attachment to perform additional types of exercises; however, this is not required. The connection arrangement to enable the swivel attachment to be removable from the seat or the swivel seat to be removable from the frame is non-limiting.

In still yet another and/or alternative non-limiting aspect of the present invention, the exercise chair of the present invention embodies a light weight folding full body fitness exercise machine. The exercise machine can optionally include one or two foot plates that retract with the seat when in the folding position. The exercise chair can optionally include a unique back rest roller padded design to provide greater comfort to the user when seated in the exercise chair. The exercise chair can optionally include a resistance system that has two pairs of resistance hubs in the form of pulley assemblies. The pulley assemblies can optionally be connected to the frame of the exercise chair so as to swivel relative to the frame (e.g., 90°, 180°, etc.). The pulley assemblies can optionally be connected to the frame of the exercise chair by L hinges/pivot points or the like to enable the pulley assembles to swivel so as to follow the movement of the one or more resistance bands or cords of the resistance system in a smooth and fast motion when the user is using the resistance system. The pulley assemblies can optionally include a center pulley guide that rotates (e.g., 90°, 180°, etc.) to guide the resistance bands or cords. The pulley assembles can optionally include one or more resistance bands or cords of the same or different tensions per bands. If two bands or cords are used having different tensions, a resistance system having three different tension levels can be created. The pulley arrangements can be optionally designed to quickly be removed from the frame of the exercise chair. The exercise chair allows a user to perform a safe and convenient workout in a time saving manner and in a convenient location. In one non-limiting configuration, the exercise chair is folding fitness sitting and standing exercise apparatus with a unique resistance system contained in a plurality of rotating pulley assembles mounted on their respective axles to the side frame and also includes one or two retractable foot plates to perform leg exercises. The exercise chair can be designed to easily and quickly fold up as a convenient compact unit for easy storage. In another and/or alternative configuration, the resistance system includes two rotational pulley assemblies. Each rotational pulley assembly includes two or three pulley housings. The pulleys can be made of any type of material (e.g., metal, plastic, composite material, etc.). The pulleys can optionally includes a housing having an angled top and contains two or three cord guide arrangement which allow the bands or cords to move thought the pulleys. The resistance bands or cords have connectors, handles, belts, etc. that are sized so as to not pass through the guide arrangement in the pulleys; however, this is not required. Each of the pulley housings can optionally be designed to have limited rotation (e.g., 45-180°) when mounted onto the frame of the exercise chair. The pulley housings can optionally include a skirt attachment area to secure a band cover to the pulley housing so as to cover or protect the bands or cords. A fixing ring or other type of connection arrangement can be used to secure the cover to the pulley housings. A pulley mount axle can be connected to or formed on the frame which is used to mount the pulley housings to the frame. The pulley mount axle can optionally have an L-shape; however, other shapes can be used. The exercise chair can optionally include one or more foot plate that can optionally be designed to automatically fold up with the seat by an attached return bar. The exercise chair can optionally include a roller padded Back rest that is ergonomically designed to support the back of the user while the user is doing sitting exercises and can also or alternatively function as a comfortable hand support while performing leg exercises when standing next to or behind the frame of the exercise chair.

It is one non-limiting object of the present invention to provide an improved exercise chair. The exercise chair is advantageous for use with elderly, disabled and handicap individuals. The exercise chair easy to use. The user merely has to sit in the chair or stand next to the exercise chair and use the resistance system on the exercise chair to work out. A foldable chair frame can be used to facilitate in the storage and/or mobility of the exercise chair.

It is another and/or alternative object of the present invention to provide an exercise chair that can be used for exercising, weight loss, muscle toning, rehabilitation, etc. without the stress of a pre-designed rigid machine. A user can merely use the resistance system on the exercise chair in accordance with the user's body height, age, sex, weight and ability. The exercise chair can be used to perform a variety of different exercises.

It is still another and/or alternative object of the present invention to provide an exercise chair that includes a swivel seat.

It is yet another and/or alternative object of the present invention to provide an exercise chair that has a removable seat.

It is still yet another and/or alternative object of the present invention to provide an exercise chair that has a resistance system that is detachable from the frame and/or seat of the exercise chair.

It is another and/or alternative object of the present invention to provide an exercise chair that has a resistance system that can be adjusted and/or reoriented on the frame and/or seat of the exercise chair.

It is still another and/or alternative object of the present invention to provide an exercise chair that enables a user to adjust the resistance levels of the resistance system.

It is yet another and/or alternative object of the present invention to provide an exercise chair that enables a user to perform a partial or full body workout from a safe, comfortable seated position. When the user is seated, balance and stability of the user can be maintained as the arms, chest, shoulders, abdomen, back, legs, etc. are exercised. The user can also stand next to the exercise chair and use the resistance system for further types of exercises if desired.

It is still yet another and/or alternative object of the present invention to provide an exercise chair that includes a resistance system having a plurality of resistance hubs to maintain the orientation and proper position of the resistance band(s) or cord(s) relative to the frame of the exercise chair when the resistance system is used by the user. The resistance system can be used to provide a user with a wide range of upper body and lower body exercises without use of heavy weights.

It is another and/or alternative object of the present invention to provide an exercise chair that provides a user with a safe, comfortable, secure and well rounded exercise routine.

It is still another and/or alternative object of the present invention to provide an exercise chair that includes one or more foot rests to provide stability to the exercise chair during use by a user.

It is yet another and/or alternative object of the present invention to provide an exercise chair that can be used as an ordinary folding chair, as well as a full body exercise device.

It is still yet another and/or alternative object of the present invention to provide an exercise chair that can fold and roll away for easy storage or use at another location.

These and other objects and advantages will become apparent to those skilled in the art upon reading and following the description taken together with the accompanying drawings.

BRIEF DESCRIPTION OF THE DRAWINGS

Reference may now be made to the drawings which illustrate various preferred embodiments that the invention may take in physical form and in certain parts and arrangement of parts wherein.

DETAILED DESCRIPTION OF NON-LIMITING EMBODIMENTS

Figure 1:
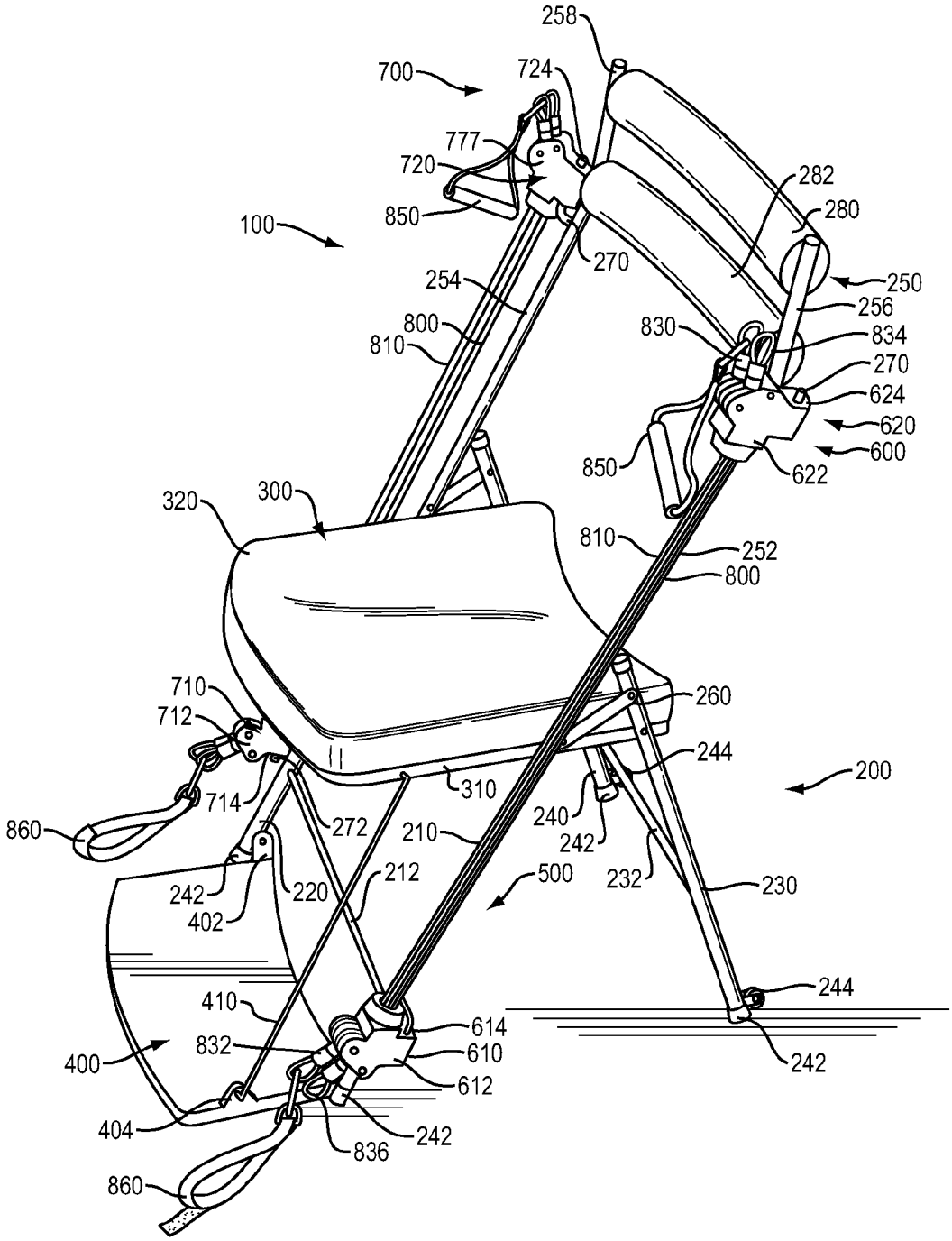
FIG. 1 is a side elevation view of the exercise chair in accordance with the present invention.

Referring now to the drawings wherein the showings are for the purpose of illustrating one non-limiting embodiment of the invention only and not for the purpose of limiting same, FIGS. 1-13 illustrate non-limiting embodiments of the exercise chair in accordance with the present invention.

Figure 6:
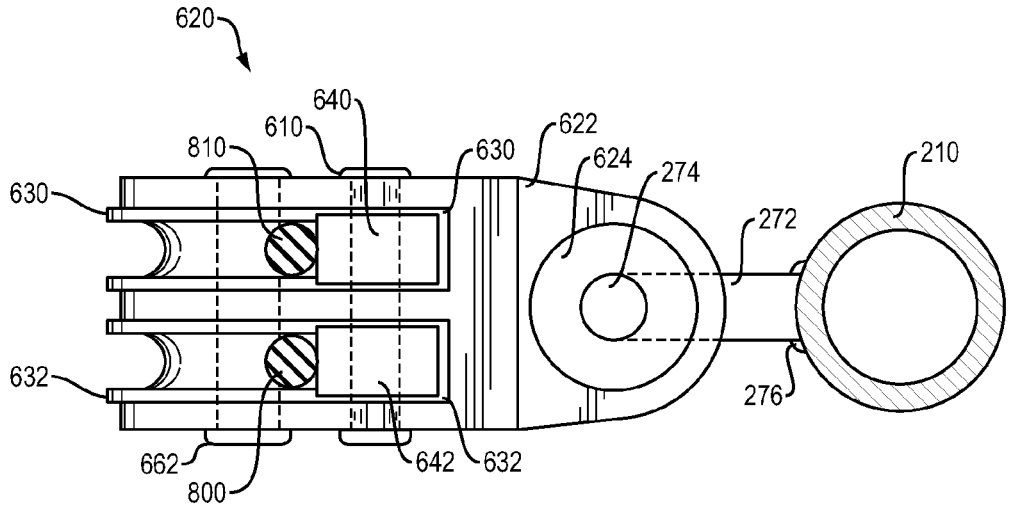
FIG. 6 is a cross-section view along line 6-6 of FIG. 5.
Figure 7:
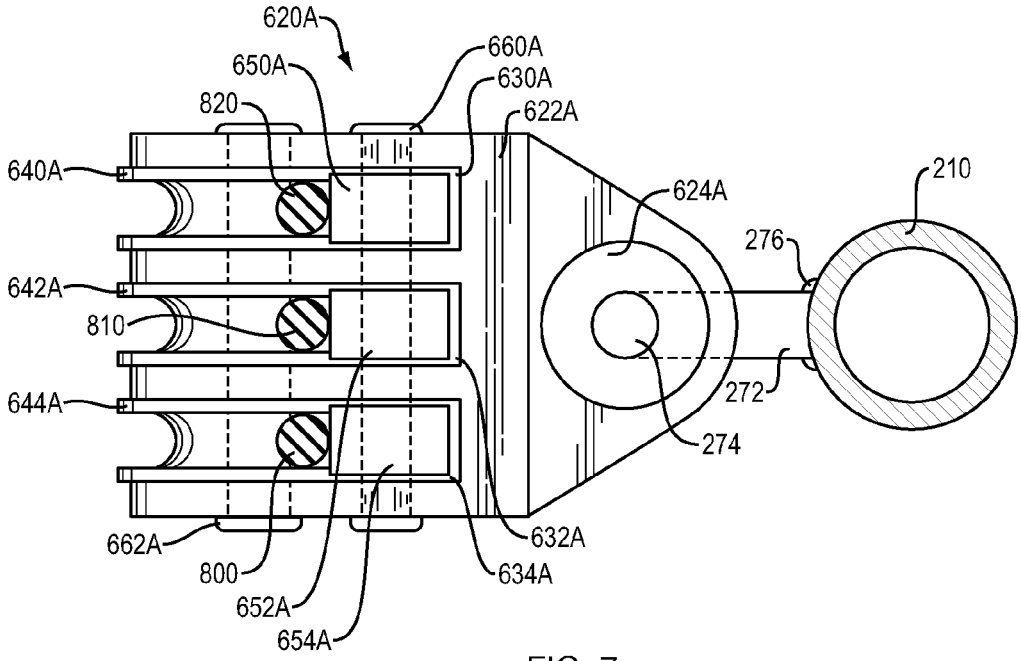
FIG. 7 is a cross-section view of an alternative configuration of a resistance hub that can be used on exercise chair of FIG. 1.
Figure 8:
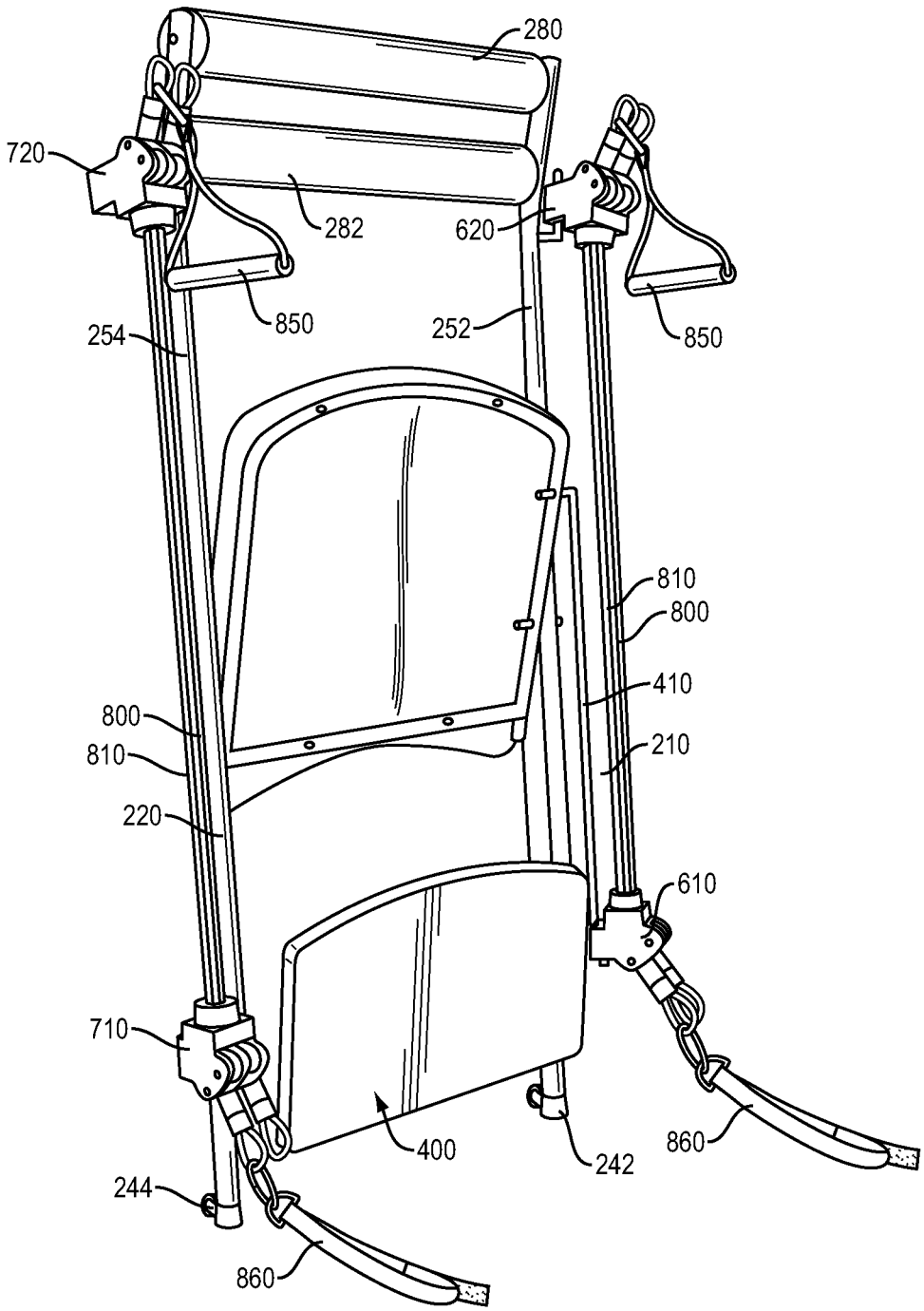
FIG. 8 is a front elevation view of the exercise chair of FIG. 1 in the folded configuration.

Referring now to FIGS. 1-8, there is illustrated a novel portable exercise chair 100 in accordance with the present invention. The exercise chair includes a frame 200, a seat 300, a foot rest 400 and a resistance system 500. The configuration of the exercise chair is non-limiting, the size, shape, color and materials used to form the exercise chair are non-limiting. As illustrated in FIGS. 1-4 and 8, the exercise chair has the general configuration of a standard folding chair. The frame 200 of the exercise chair has two front legs 210, 220, two rear legs 230, 240, and a back support 250. The frame can be formed of hollow tubing, wood, plastic or any other desirable material. As illustrated in FIGS. 1-4 and 8, the frame is formed of a tubular material. The exercise chair can optionally include support and/or reinforcement members to stabilize and/or rigidify the frame. As illustrated in FIGS. 1, 3, 4 and 8, a cross-bar 212 is connected between the two front legs and a cross-bar 232 is connected between the two back legs. The ends of one or more of the legs can optionally include a gripping member to inhibit or prevent movement of the frame on a floor surface F when the user is using the exercise chair. The configuration and materials used to form the gripping members, when used, are non-limiting. Plastic or rubber caps 242 are illustrated as being inserted in the ends of each of the legs. A bracket arrangement 260 is used to connect the back legs to the front legs. As can be appreciated, the front and back legs can be connected or interconnected together in other arrangements for differently configured chair frames. Bracket 260 is designed to enable the frame of the exercise chair to be folded as illustrated in FIG. 8. The configuration of the bracket to enable the chair frame to be folder can be a conventional bracket arrangement. The manner in which the bracket is connected to the front and back legs is non-limiting. The manner in which the frame can be folded in known in the art, thus will not be further described herein.

The back legs can optionally include rollers or wheels 244 to enable the exercise chair to be easily moved on a floor surface F. The configuration of the rollers or wheels and/or the manner in which the rollers or wheels are mounted (e.g., swivel mount, bracket mount, etc.) to the back legs are non-limiting. As illustrated in FIG. 8, when the exercise chair is folded, the exercise chair can then be tilted so that the wheels engage the floor surface and enable the exercise chair to be rolled on the floor surface. As illustrated in FIGS. 1, 2, 4 and 8, the rollers or wheels are optionally mounted to the back legs such that the rollers or wheels are elevated above the floor surface when the frame of the exercise chair is in the open and use position.

The back support 250 extends upwardly from the seat and is used to support the back of the user when sitting in the exercise chair. The configuration of the back support is non-limiting. The non-limiting back portion illustrated in FIGS. 1-4 and 8 includes two side sections 252, 254 that extend upwardly from the seat 300. As illustrated in FIGS. 1-4 and 8, the upper portion of front legs 210 and 220 are illustrated as forming side sections 252, 254; however, this is not required. As can be appreciated, side sections 252, 254 can be separate components that are designed to be connected to the front legs (e.g., telescopic connection, etc.). The top section 256, 258 of the back support includes two back rests 280, 282. The back rest can optionally be formed of a compressible material to provide comfort to the user when sitting in the exercise chair. The two back rests are illustrated as having a tubular or cylindrical shape; however, this is not required. The two back rests are illustrated as being spaced apart; however, this is not required. The configuration, materials, size, shape and material of the one or more back rests used on the back support are non-limiting. The back rest can be connected to the top section of the back support in an manner (e.g., screw, bolt, rivet, adhesive, weld bead, solder, etc.). The top section, 256, 258 of the back support is illustrated as bending up from the side sections 252, 254; however, this is not required. A portion or all of the top section 256 and side section 252 can be a single part; however, this is not required. Likewise, a portion or all of the top section 258 and side section 254 can be a single part; however, this is not required. The back rests can be ergonomically designed to support the back while doing sitting exercises and/or be used as support by hands and arms when performing standing exercises in the front or back of the exercise chair; however, this is not required.

Figure 11:
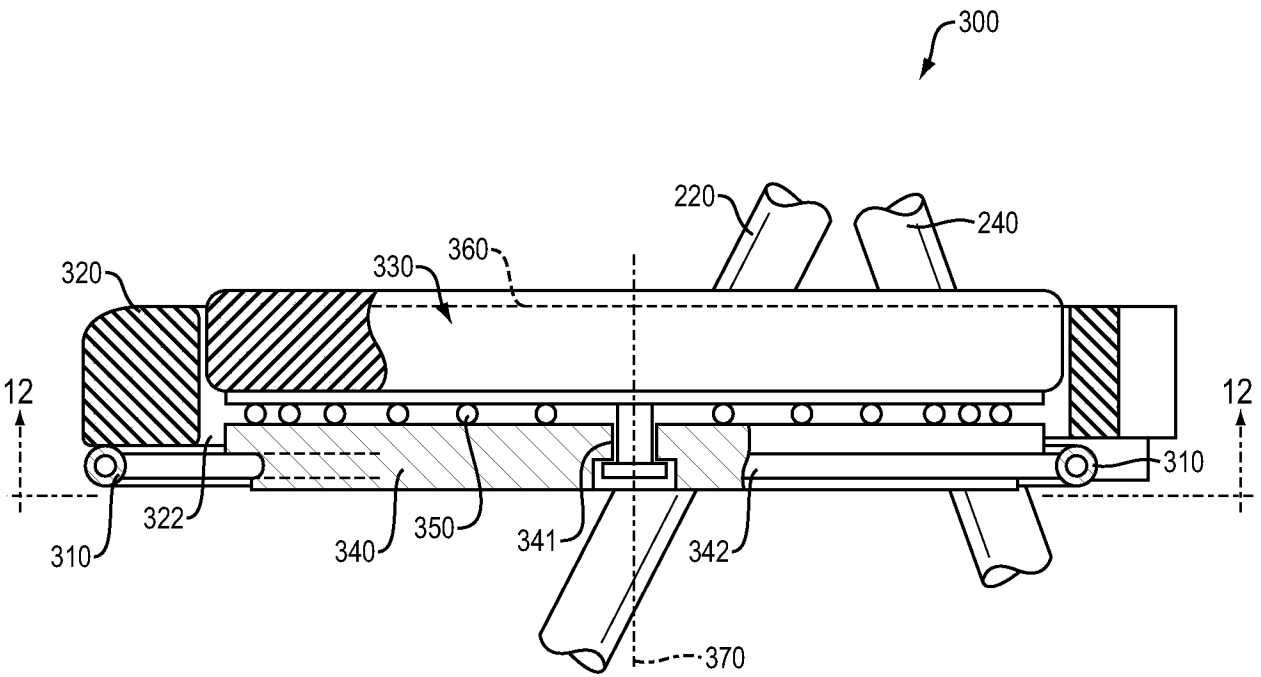
FIG. 11 is a cross-section view along line 11-11 of FIG. 9.
Figure 12:
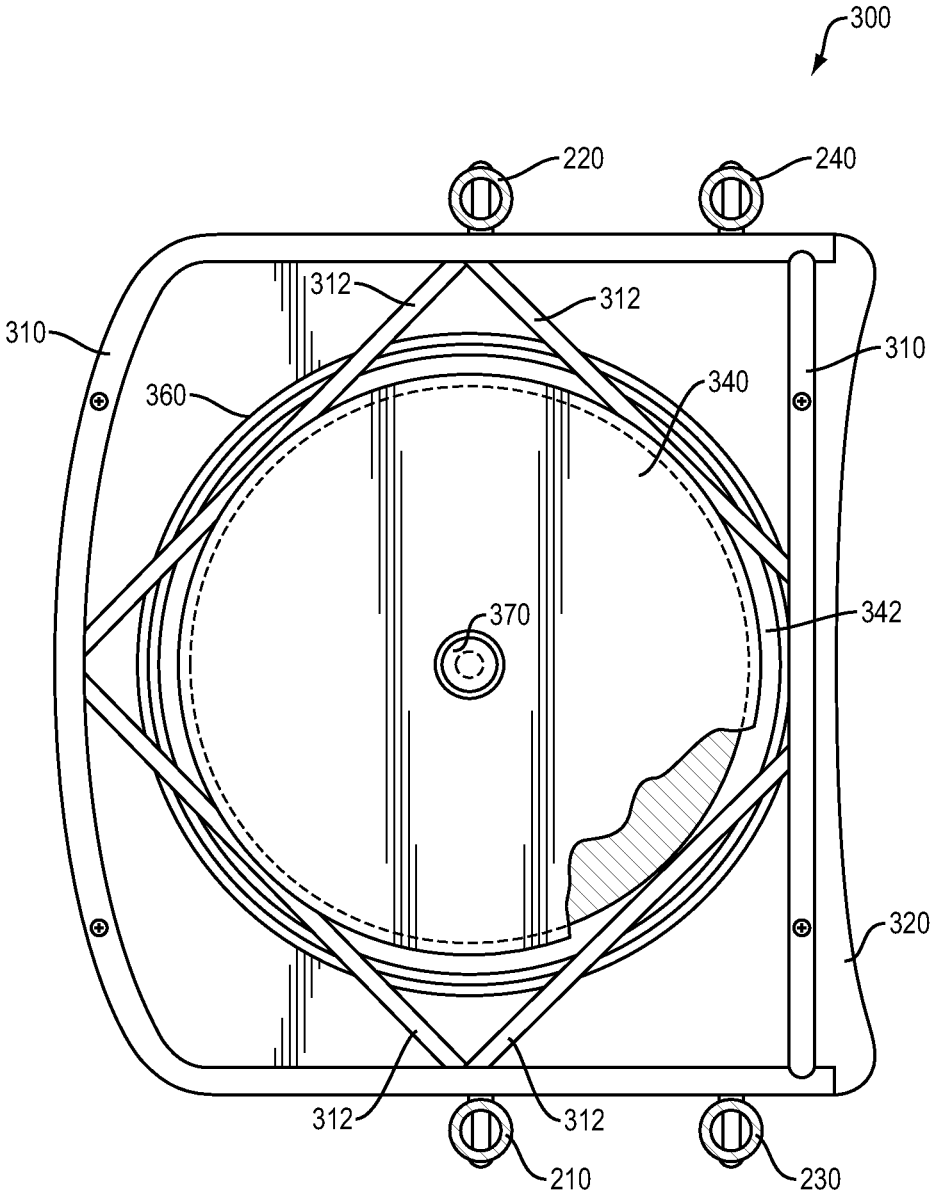
FIG. 12 is a cross-section view along line 12-12 of FIG. 11.
Figure 13:
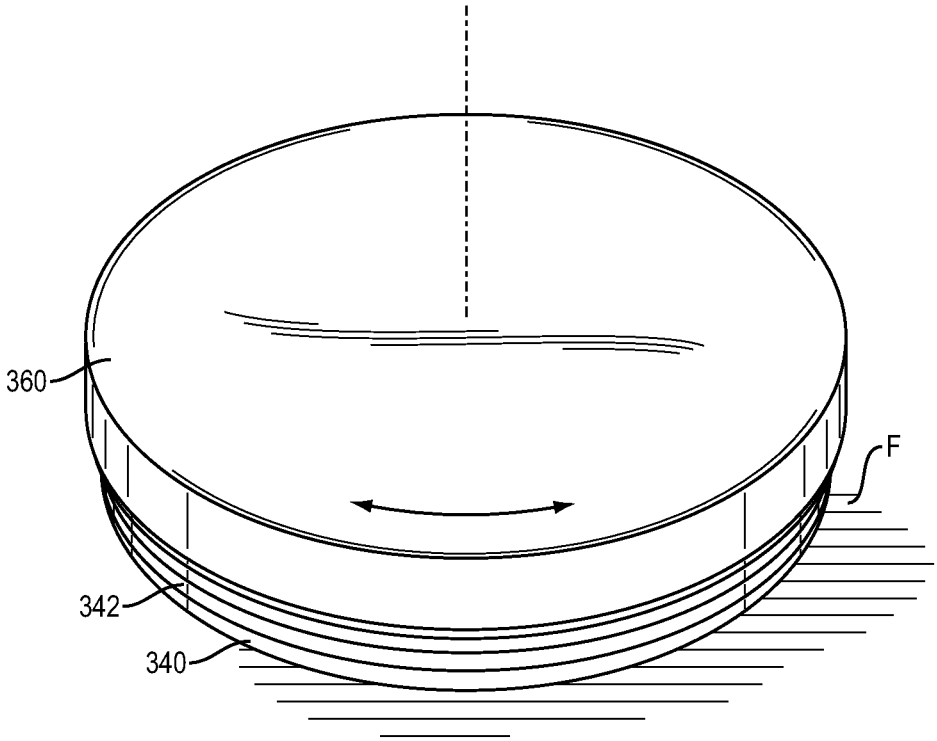
FIG. 13 is a side elevation view of the removable portion of a seat as illustrated in FIG. 9.

As illustrated in FIGS. 1-4 and 8, seat 300 is connected to both the front and back legs; however, this is not required. The seat includes a frame portion 310 and a padded portion 320; however, this is not required. When the seat includes a padded portion 320, the padded portion can be formed of a compressible material; however, this is not required. The materials, size, color, shape and configuration of the seat are non-limiting. The frame portion of the seat is generally designed to be connected to the front and back legs and/or the bracket arrangement 260; however, other or additional portion of the seat can be connected to the front and back legs and/or the bracket arrangement 260. The seat can be optionally designed to be foldable as illustrated in FIG. 8. The seat can optionally be designed to be partially or fully removable from the chair frame. Also or alternatively, the padded portion can optionally be designed to be detachable from the frame portion 310. As can be appreciated, a swivel seat can be alternatively be used with the exercise chair illustrated in FIG. 1. One non-limiting swivel seat that can be used is illustrated in FIGS. 11-13, which will be described in more detail below.

One or more foot rest 400 can be optionally included on the exercise chair. The size, shape, configuration and materials used for the foot rest are non-limiting. As illustrated in FIGS. 1-4 and 8, the exercise chair includes a single foot rest 400 connected to the front legs of the chair frame. The foot rest can be optionally pivotally connected to the front legs. The type of connection used to connect the foot rest to the front legs is non-limiting. Mount tabs 402 are optionally included in the foot rest to mount the foot rest to the front legs. The foot rest can optionally be used with a raise rod 410 to cause the foot rest to pivot on the front legs and move to a folded-up position as illustrated in FIG. 8 when the exercise chair is folded-up. As can be appreciated, other or additional arrangements can be used to cause the foot rest to pivot when the exercise chair is folded and unfolded. The raise rod, when used, can be connected between the foot rest and the seat; however, it can be appreciated that raise rod can be connected to other locations on the frame of the exercise chair. The foot rest is illustrated in FIGS. 1-4 and 8 as including a rod tab 404 that enables the raise rod to connect to the foot rest. As can be appreciated, other or additional arrangements can be used to enable the raise rod to be connected to the foot rest. The opposite end of the raise rod is illustrated as being connected to the frame portion 310 of the seat; however, it can be appreciated that the raise rod can be also or alternatively connected to the padded portion of the seat. Only one raise rod is illustrated in FIGS. 1-4 and 8; however, it can be appreciated that more than one raise rod can be used to move the foot rest. The foot rest is generally mounted so that the bottom surface of the foot rest partially or fully contacts the floor surface F when the foot rest is folded down for use as illustrated in FIGS. 1-4. The bottom surface can optionally including a gripping surface to inhibit or prevent movement of the floor rest on the floor surface when a user is stepping or standing on the top surface of the foot rest. As also can be appreciated, the top surface of the foot rest can include a gripping surface to inhibit or prevent slippage when a user's feet are positioned on the top surface of the foot rest; however, this is not required. As can be appreciated, the foot rest can be detachably connected to the frame of the exercise chair. As also can be appreciated, the foot rest optionally can be designed to be detachably connected to the front and back legs so that the foot rest can be moved by the user to the front or back legs. As also can be appreciated, two foot rests can be included on the exercise chair. One non-limiting two foot rest configuration that can be used on the exercise chair illustrated in FIG. 1 is illustrated on the exercise chair illustrated in FIGS. 9-10. The use of an optional second foot on the exercise chair will be described in more detail below.

Figure 4:
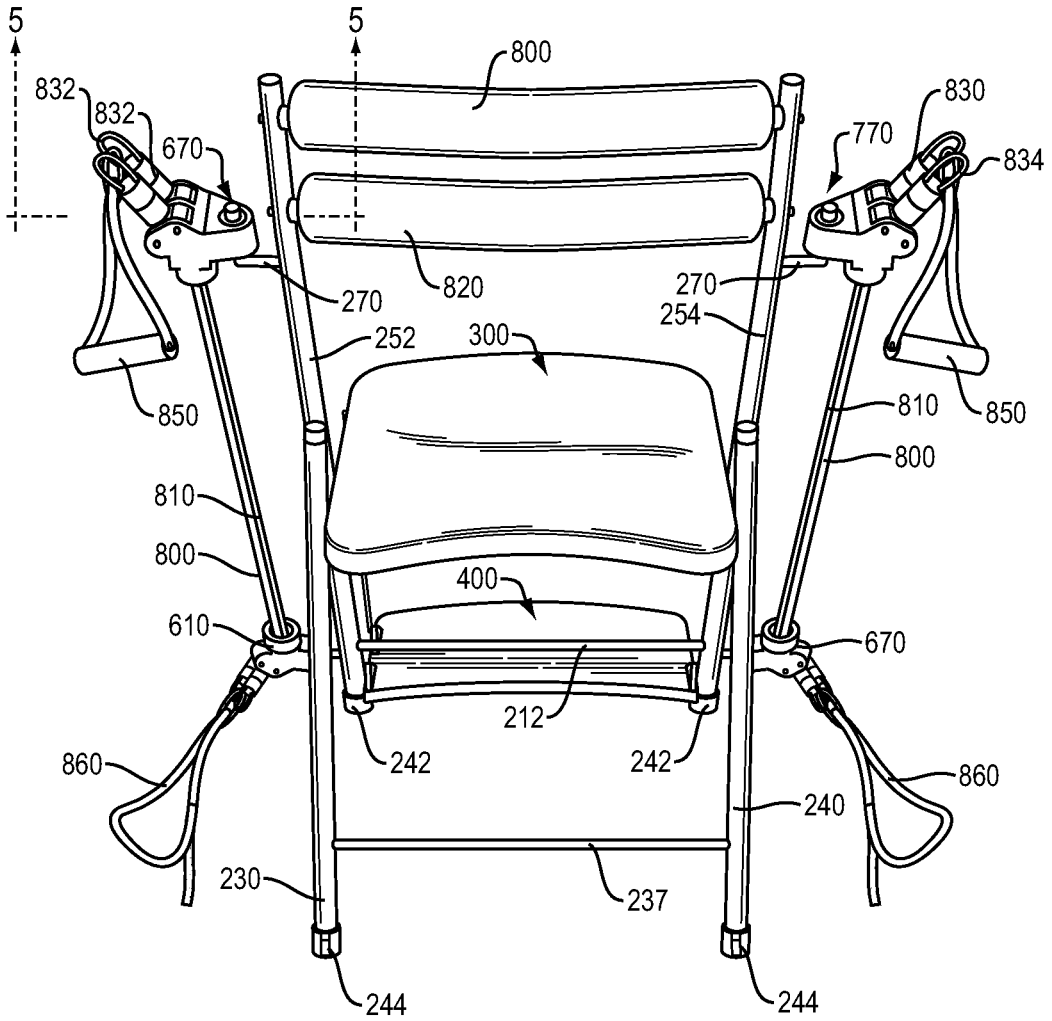
FIG. 4 is a back elevation view of the exercise chair of FIG. 1.
Figure 5:
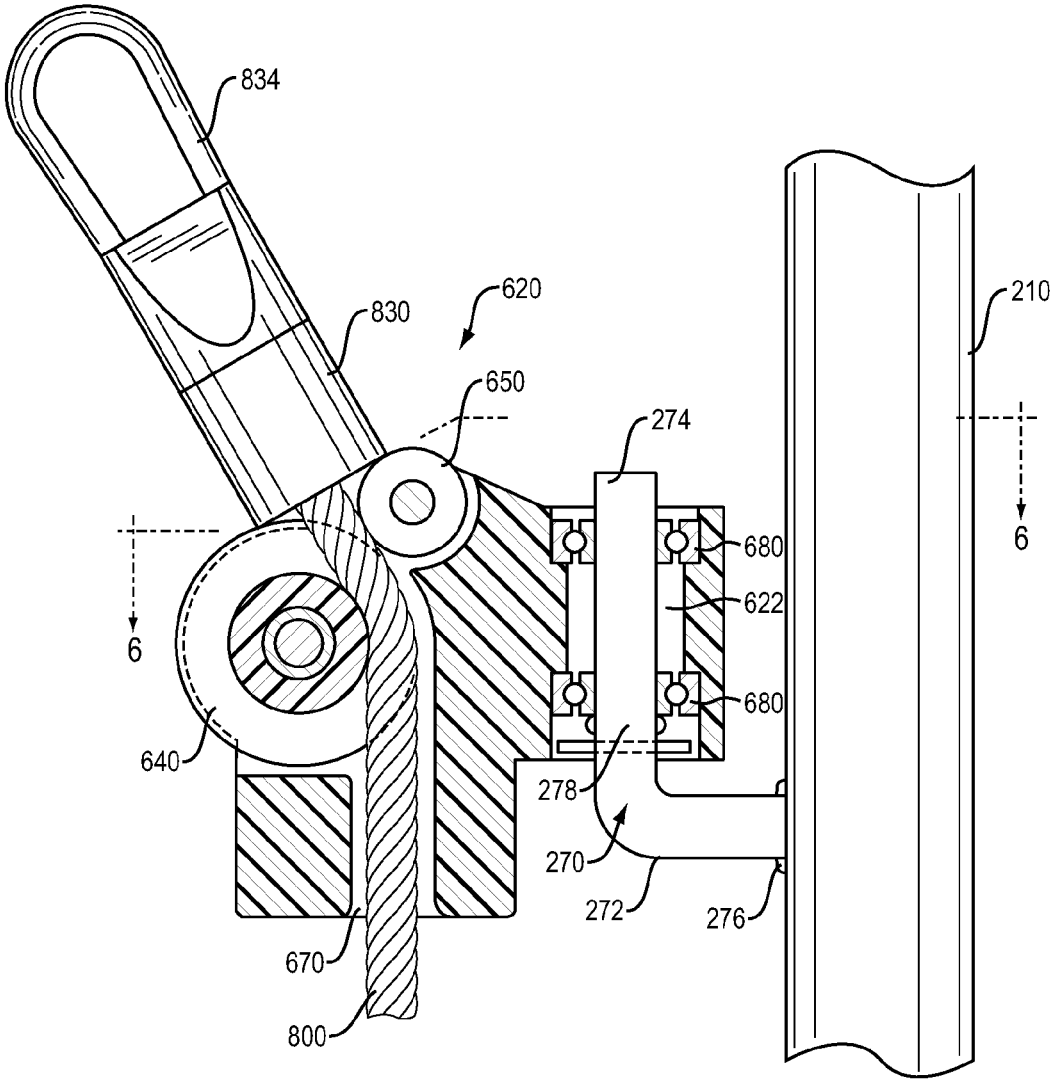
FIG. 5 is a cross-section view along line 5-5 of FIG. 4.

The exercise chair illustrated in FIGS. 1-13 includes the use of a novel resistance system 500. As illustrated in FIG. 1, the resistance system 500 includes two resistance arrangements 600, 700 positioned on each side of the frame of the exercise chair. The two resistance arrangements are optionally configured the same so that either resistance arrangement can be connected to either side of the frame of the exercise chair. Each of the resistance arrangement includes two resistance hubs or pulley arrangements 610, 620, 710, 720 that are connected to hub connectors 272, 270 located on the front legs 210, 220 and the side sections 252, 254 of the back support, respectively. As illustrated in FIG. 5, the hub connectors have a generally L-shape configuration; however, this is not required. The configuration of the hub connectors is generally the same so that either resistance hub on either resistance arrangement can be connected to any of the hub connectors; however, this is not required. As illustrated in FIG. 5, the hub connectors include a base portion 272 and a leg portion 274. The base portion is illustrated as being connected to the frame of the exercise chair. The type of connection between the base portion and the frame is non-limiting. A weld bead 276 is illustrated as being used to connect the base portion of the hub connector to the chair frame. The base portion is illustrated as extending outwardly from the chair frame; however, this is not required. As illustrated in FIG. 5, the base portion is extending outwardly from the chair frame at an angle o about 30°-150°, typically 45°-135°, more typically 60°-120°, still more typically about 80°-100°, and even more typically about 90°. The length of the base portion is generally less than the length of the leg portion; however, the lengths can be the same or the length of the base portion can be longer than the length of the leg portion. The cross-sectional shape of the base portion and leg portion is generally the same; however, this is not required. As illustrated in FIGS. 6 and 7, the cross-sectional shape of the leg portion can be circular; however, this is not required. The leg portion on the hub connectors extends upwardly for the hub connectors connected to side sections 252, 254 of the back support. The leg portion on the hub connectors extends downwardly for the hub connectors connected to front legs 210, 220. This orientation of the leg portions facilitates in maintaining the resistance hubs on the hub connections as will be described in more detail below.

Referring to FIGS. 1-7, each of the resistance arrangements include one or more resistance bands or cords 800, 810, 820. The resistance bands or cords can be formed of many different types of materials. One non-limiting type of resistance cord is a bungee or stock cord. Each of the resistance bands or cords used can have the same or different type of resistance. For example, one or more of the resistance bands or cords can have a resistance in pounds of 5-15 lbs., or 15-30 lbs., or 30-45 lbs., etc. The resistance bands or cords can be color coded, labeled, etc. to indicate the resistance in pounds of each resistance band or cord; however, this is not required. The one or more resistance bands or cords can be designed to be removable and replaceable on the resistance hubs; however, this is not required. The resistance bands or cords can be designed to stretch up to about 25%-500% of its original length (e.g., length when no force is applied to the resistance band or cord), typically, the resistance bands or cords can be designed to stretch up to about 50%-400% of its original length, and more typically the resistance bands or cords can be designed to stretch up to about 100%-300% of its original length. As can be appreciated, the resistance bands or cords can be designed to stretch to other lengths.

Figure 2:
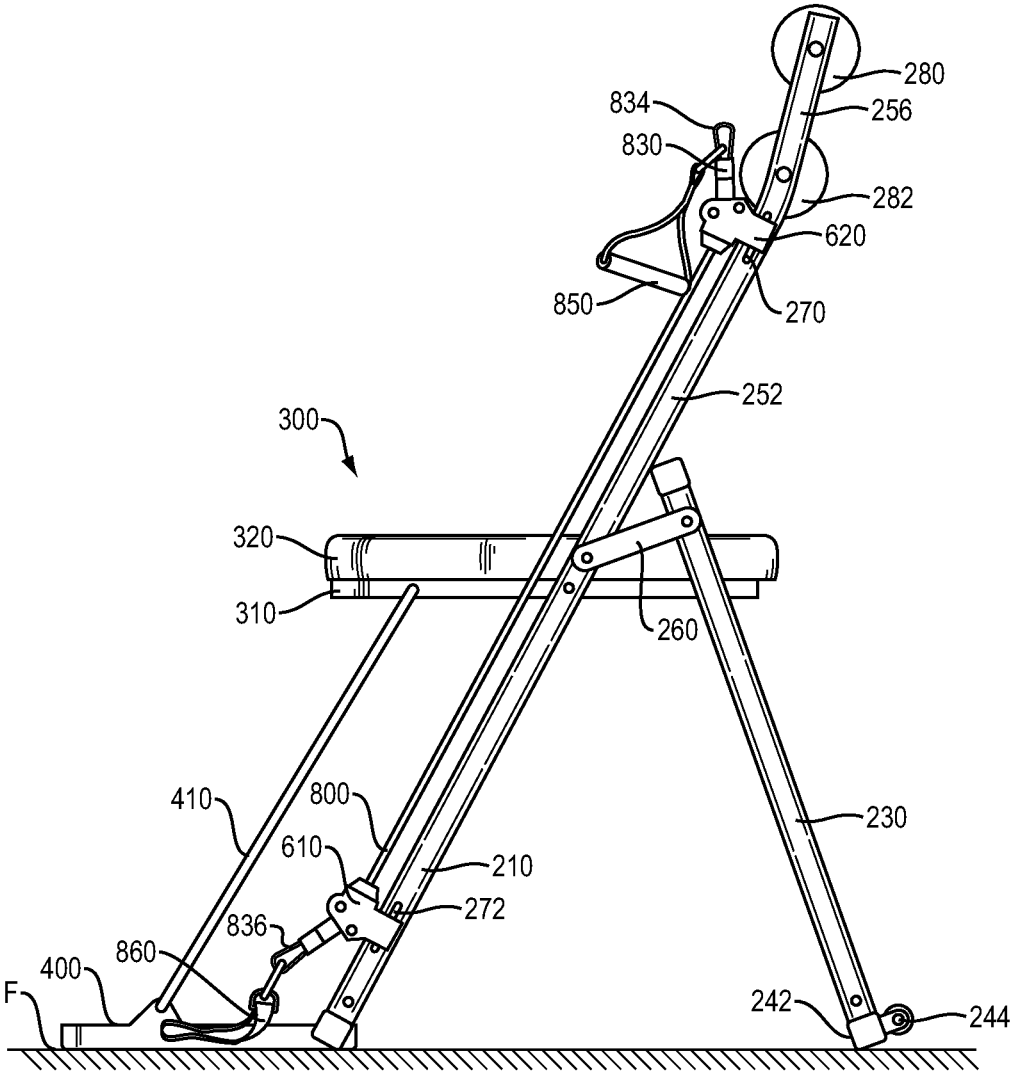
FIG. 2 is a side view of the exercise chair of FIG. 1.
Figure 3:
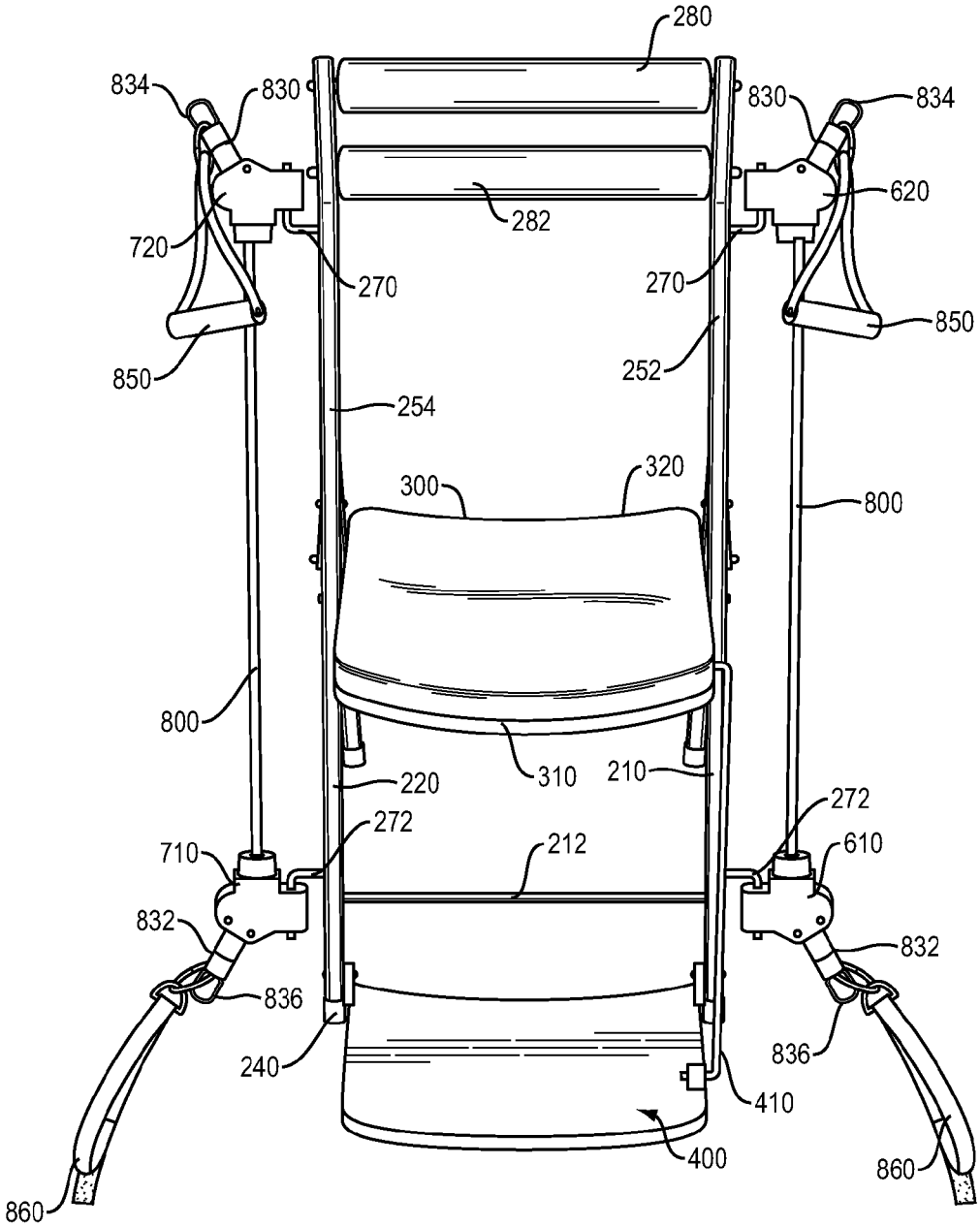
FIG. 3 is a front elevation view of the exercise chair of FIG. 1.

Each of the resistance hubs includes a body 612, 622, 712, 722 that has a connection opening 622, 624, 714, 724 that is designed to receive the leg portion of the hub connector. Leg mount rings or bearings 680 can be positioned in the connection opening to facilitate in the proper mounting of the resistance hub to the leg portion of the hub connector. As can be appreciated, other or additional arrangements can be used to facilitate in the proper mounting of the resistance hub to the leg portion of the hub connector. The configuration of the connection opening in conjunction with the configuration of the leg portion of the hub connector can be optionally designed to limit the amount or degree to which the resistance hub can rotate on the leg portion of the hub connector. One such arrangement is illustrated in FIG. 5. The hub connector 270 includes a pin 278 that limits the amount of rotation of the resistance hub on the leg portion. The pin can be designed to engage a limiting structure in the body of the resistance hub to limit further rotation of the resistance hub when the limiting structure contact pin 278. As can be appreciated, other or additional arrangements can be used to limit the rotation of the resistance hub on the hub connector. In one non-limiting design, the configuration of the connection opening and/or the configuration of the leg portion of the hub connector are such that the resistance hub can only rotate less than 360° on the leg portion of the hub connector, typically rotate only up to 270° on the leg portion of the hub connector, more typically rotate only up to 270° on the leg portion of the hub connector 180°, and still more typically rotate only up to 90° on the leg portion of the hub connector. In one non-limiting design, the configuration of the connection opening and/or the configuration of the leg portion of the hub connector are such that the resistance hub can only rotate up to 90° on the leg portion of the hub connector. As illustrated in FIGS. 1 and 2, the body of the resistance hub is oriented at about a 90° angle relative to the longitudinal axis of the base portion of the hub connector. As illustrated in FIGS. 3 and 4, the body of the resistance hub is oriented at about a 0° angle relative to the longitudinal axis of the base portion of the hub connector. These two positions of the resistance hub represent the maximum rotation positions of the resistance hub on the hub connector when the resistance hub can only rotate up to 90° on the hub connector. As can be appreciated, this non-limiting example represent just one of many orientations of the resistance hub on the hub connector when the resistance hub can only rotate up to 90° on the hub connector.

Referring now to FIGS. 1, 6 and 7, resistance hub 620 includes a plurality of grooved wheels and a corresponding guide roller. The structure and operation of resistance hub 620 will be described in detail as follows; however, it will be understood that the structure and operation of resistance hubs 610, 710 and 720 is the same as resistance hub 620. Referring to FIG. 6, resistance hub 620 includes two wheel slots 630, 632. Each of the wheel slots includes a grooved wheel 640, 642 and a corresponding guide roller 650, 652. The grooved portion of the grooved wheels is designed to receive a portion of one resistance band or cord 800, 810. The guide roller for each one of the grooved wheels is designed to maintain the resistance band or cord as the resistance band or cord moves on the grooved wheel. Both the groove wheel and the guide roller are deigned to rotate; however, this is not required. Rotation pins 660, 662 are used to mount the groove wheel and the guide roller to the body of the resistance hub. As can be appreciated, other or additional arrangements can be used to mount the groove wheel and the guide roller to the body of the resistance hub and enable the groove wheel and/or the guide roller to rotate in the wheel slots. The configuration of the groove wheel and the guide roller are non-limiting. As can be appreciated, the groove wheel can optionally be designed to be absent a groove. As can also or alternatively be appreciated, the guide roller can optionally be designed to include a groove. Generally, the grooved wheel has a larger radius than the guide roller; however, this is not required. The lower portion of the body of the resistance hub includes an opening 670 for the resistance band or cord to enter the body of the resistance hub. The opening 670 can include a single opening for all of the resistance bands or cords or individual openings for each resistance band or cord.

As illustrated in FIG. 7, resistance hub 620A includes three wheel slots 630A, 632A, 634A. Each of the wheel slots includes a grooved wheel 640A, 642A, 644A and a corresponding guide roller 650A, 652A, 654A. The grooved portion of the grooved wheels is designed to receive a portion of one resistance band or cord 800, 810, 820. Rotation pins 660A, 662A are used to mount the groove wheel and the guide roller to the body of the resistance hub. As can be appreciated, other or additional arrangements can be used to mount the groove wheel and the guide roller to the body of the resistance hub and enable the groove wheel and/or the guide roller to rotate in the wheel slots. The operation of the guide roller for each one of the grooved wheels is the same as designed above regarding the resistance hub illustrated in FIG. 6, thus will not be repeated herein.

Referring now to FIGS. 1-4, each of the resistance band or cord include an end connector 830, 832 at each end of the resistance band or cord. The body of the connector is shaped and sized so that it cannot fully fit through the space between the groove wheel and corresponding guide roller on the resistance hub as illustrated in FIG. 5; however, this is not required. The end connectors on the resistance band or cord are illustrated as having the same configuration; however, this is not required. As illustrated in FIGS. 1-4, the length of the resistance band or cord are selected such that one or more of the resistance band or cord are partially stretched when the resistance hubs are mounted on the front legs and the side sections of the back support. Such partial stretching of one or all of the resistance bands or cords results in the resistance hub being maintained on the leg portion of the hub connectors. During installation, one resistance hub is first connected to the side section of the back support and the other resistance hub is moved to the front leg to cause one or more the resistance bands or cords to partially stretch and then the resistance hub is connected to the front leg of the chair frame. The resistance hub is generally designed so that it can be easily slipped on and off of the leg portion of the hub connector for easy assembly and disassembly; however, this is not required.

The connectors on the resistance band or cord includes a connection ring 834, 836 that is designed to connected to a handle, Velcro band, strap, foot connector, hand connector, etc. The connection ring can be designed to rotate relative to the end connector; however, this is not required. As illustrated in FIG. 1, a handle 850 is connected to connection ring 834. The configuration, color, shape, and materials of the handle are non-limiting. The handle is used by a user to be grasped and pulled when performing one or more exercises when using the exercise chair. The handle is designed to be connected to only one or both of the connection rings that are positioned on resistance hub 620. The ability of the user to connect to one or both connection rings enables the user to select a designed level of resistance when exercising. Connection of the handle to a single connection ring results in either resistance band or cord 800 or resistance band or cord 820 being stretched during the exercise when the user is using handle 850. Connection of the handle to both connection rings results in both resistance band or cord 800 and resistance band or cord 820 being stretched during the exercise when the user is using handle 850. As can be appreciated, when the resistance hub is configured to hold three resistance bands or cords as illustrated in FIG. 7, the user can connect the handle to one, two or three of the resistance bands or cords during an exercise to adjust the resistance to a desired level.

The ability of the handle to be disconnected and reconnected to the connection rights enables the handle to be moved, if desired, to be connected to one or more of the connection rings 836 on the end of resistance band or cord located at resistance hub 610 or some other resistance hub. The ability of the handle to be moved to any of the connection rings on the end of resistance band or cord located at resistance hubs 610, 620, 710, 720 results in an expanded number of different exercises that can be performed by the user when using the exercise chair.

As illustrated in FIG. 1, a foot strap 860 is illustrated as being connected to connection rings 836 on resistance hub 610. The configuration, color, shape, and materials of the foot strap are non-limiting. The foot strap is designed to be connected to a user's foot to perform various leg exercises while sitting in the exercise chair or when standing on the foot rest 400. The foot strap can have many different configurations. As illustrated in FIG. 1, the foot strap is a strap having two ends that can be releasably connected together (e.g., Velcro or hook and loop connection, snap connection, etc.). As with the handle, the foot strap can also be connected to one or more of the connection ring on the end of resistance band or cord located at any of the resistance hubs. The connector on the foot strap and handle can be the same type of connector; however, this is not required.

When in use, the handle and the foot strap can be used individually or together depending on the type of exercise and the amount of designed resistance. The handle and foot strap can be connected to the same or different resistance band or cord when performing the exercises.

Referring now to FIGS. 9-13, there is illustrated a modification of the exercise chair that is illustrated in FIGS. 1-8. Exercise chair 100A is the same the exercise chair 100 except for the inclusion of an additional foot rest 450, a modified seat 300, the inclusion of hub connectors on the back legs of the chair frame, the inclusion of intermediate resistant hubs on the two resistance arrangements 600, 700, and the inclusion of intermediate hub connectors on the chair frame. The parts of exercise chair 100A that are the same as exercise chair 100 are similarly number and will not be further described.

Figure 9:
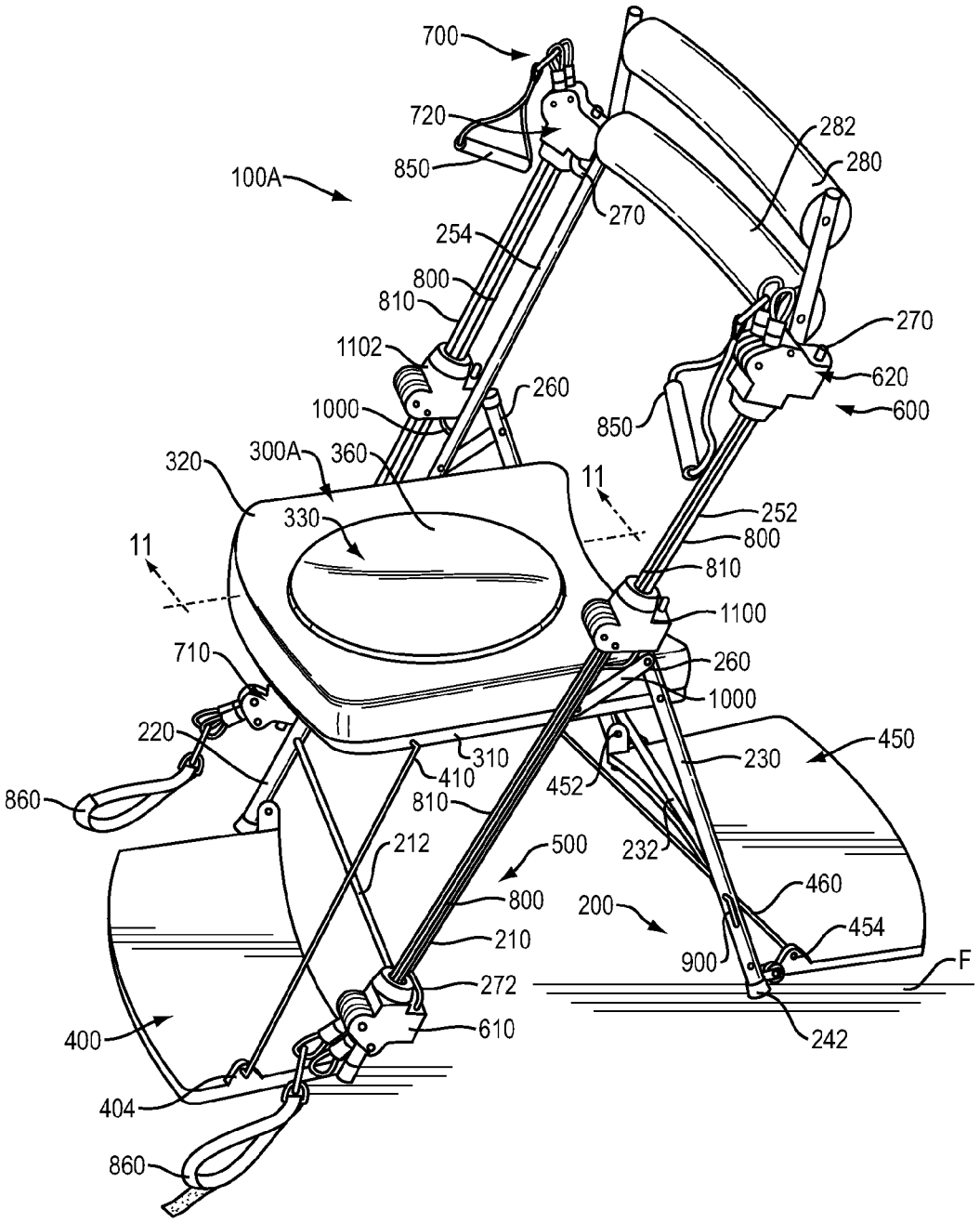
FIG. 9 is a side elevation view of an alternative configuration of the exercise chair in accordance with the present invention.
Figure 10:
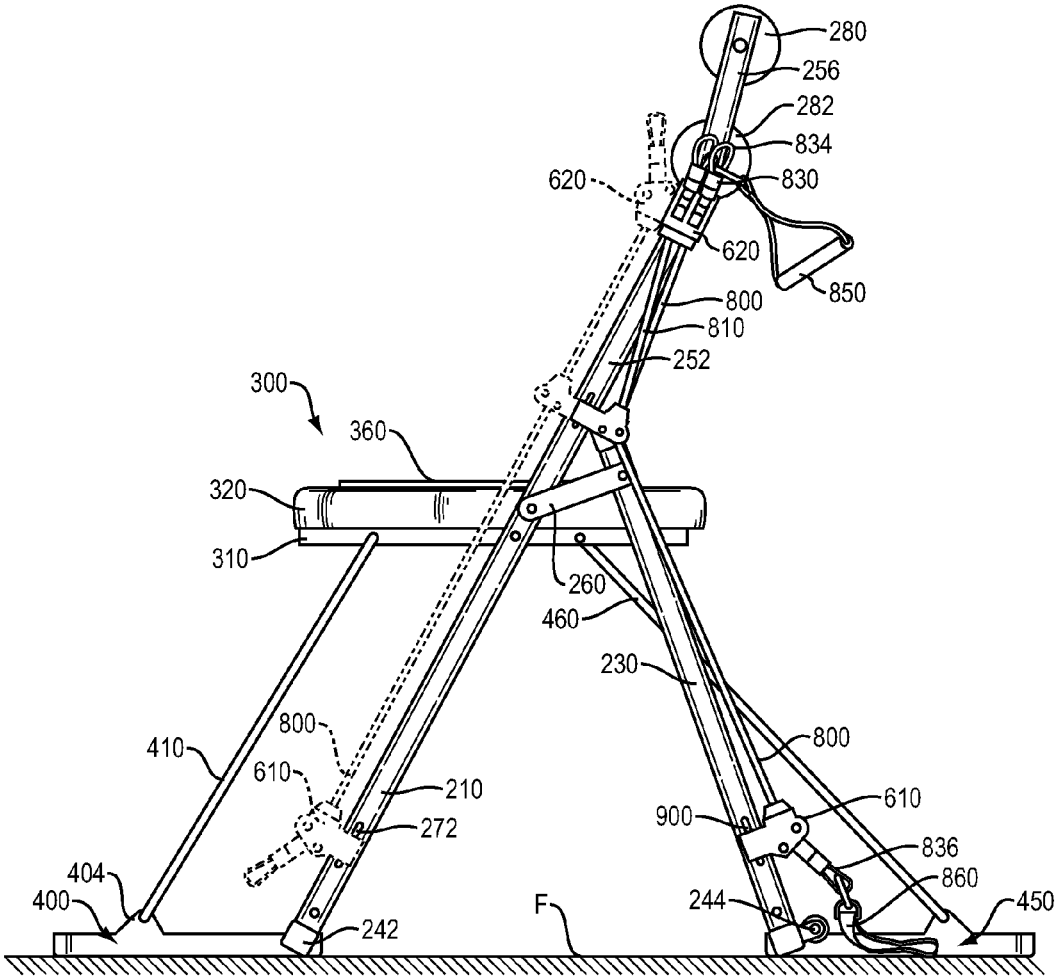
FIG. 10 is a side view of the exercise chair of FIG. 9.

As illustrated in FIGS. 9 and 10, exercise chair 100A includes a second foot rest 450 that is connected to the back legs 230, 240 of the chair frame. The size, shape, configuration and materials used for the foot rest are non-limiting. The foot rest can be optionally pivotally connected to the front legs. The type of connection used to connect the foot rest to the back legs is non-limiting. Mount tabs 452 are optionally included in the foot rest to mount the foot rest to the back legs. The foot rest can optionally be used with a raise rod 460 to cause the foot rest to pivot on the back legs and move to a folded-up position when the exercise chair is folded-up. As can be appreciated, other or additional arrangements can be used to cause the foot rest to pivot when the exercise chair is folded and unfolded. The raise rod, when used, can be connected between the foot rest and the seat; however, it can be appreciated that raise rod can be connected to other locations on the frame of the exercise chair. The foot rest includes a rod tab 454 that enables the raise rod to connect to the foot rest. As can be appreciated, other or additional arrangements can be used to enable the raise rod to be connected to the foot rest. The opposite end of the raise rod is illustrated as being connected to the frame portion 310 of the seat; however, it can be appreciated that the raise rod can be also or alternatively connected to the padded portion of the seat. Only one raise rod is illustrated in FIGS. 9 and 10; however, it can be appreciated that more than one raise rod can be used to move the foot rest. The foot rest is generally mounted no that the bottom surface of the foot rest partially or fully contacts the floor surface F when the foot rest is folded down for use as illustrated in FIGS. 9 and 10. The bottom surface can optionally including a gripping surface to inhibit or prevent movement of the floor rest on the floor surface when a user is stepping or standing on the top surface of the foot rest. As also can be appreciated, the top surface of the foot rest can include a gripping surface to inhibit or prevent slippage when a user's feet are positioned on the top surface of the foot rest; however, this is not required. As can be appreciated, the foot rest can be detachably connected to the frame of the exercise chair.

Referring now to FIGS. 9-13, the exercise chair can optionally include a swivel seat 300A. As can be appreciated, exercise chair 100A can also include seat 300 illustrated in FIG. 1. Seat 300A is illustrated as including a frame portion 310 and a padded portion 320. The center of the seat includes a removable swivel section 330. The swivel section can include a padded material that is the same or similar to the padded material that can be used in the padded portion 230; however, this is not required.

Referring now to FIGS. 11-13, the swivel portion is optionally removable and can be removed from the seat frame and placed on a floor surface as illustrated in FIG. 13. When the swivel section is on the floor surface, a user can sit or stand on the swivel section and perform additional types of exercises. Many different arrangements can be used to detachably secure the swivel section to the frame portion of the seat. As illustrated in FIGS. 11 and 12, the frame portion includes reinforcement structures 312. The bottom of the swivel section includes a mount plate 340 is connected to the frame portion and/or the reinforcement structures. As illustrated in FIGS. 11 and 13, the mount plate includes a connection groove 342 that can be used to snap connect the mount plate to the reinforcement structures. As can be appreciated, other or additional arrangements can be used to secure the mount plate to the frame portion and/or the reinforcement structures. The snap connection can be designed to enable the swivel portion to be connected and disconnected from the frame portion of the seat; however, this is not required. A plurality of ball bearings 350 are illustrated as being positioned between the top surface of the mount plate 340 and the bottom surface of the padded seat portion 360. The ball bearings are used to enable the padded seat portion to rotate relative to the mount plate. As can be appreciated, other or additional means can be used to enable the padded seat portion to rotate relative to the mount plate. As illustrated in FIG. 11, the padded seat portion 360 is at least partially positioned in a rotated within a seat cavity 322 in the padded portion 320. The top surface of the padded seat portion 360 is illustrated as being positioned above the top surface of the padded portion 320; however, this is not required. The padded seat portion 360 includes a central axle 370 that is designed to extend through an axle opening 344 in the mount plate. The bottom portion of the central axle has a large cross-sectional area than the body of the central axle so as to prevent the padded seat portion 360 from being separated from the mount plate. As can be appreciated, other or additional arrangements can be used to secure the padded seat portion 360 to the mount plate and enable the padded seat portion to rotate 0 relative to the mount plate. The padded seat portion is generally designed to rotate 360° relative to the mount plate; however, the padded seat portion can be designed to rotate less than 360° relative to the mount plate. The swivel seat can be used by the user to perform many different twisting exercisers movements when seated on the swivel seat or when the user portions his/her knees, hands or feet on the swivel seat.

Referring now to FIGS. 9 and 10, exercise chair 100A includes hub connectors 900 on the back legs of the chair frame. Hub connections 900 are generally the same shape, size and configuration as hub connectors 272 on the front legs. In addition, the orientation the hub connections 900 on the back legs is generally the same as the orientation of the hub connectors 272 on the front legs. As such, resistance hubs 610, 710 can be interchangeably connected to the hub connectors on the front and back legs as illustrated in FIGS. 9 and 10. The connection of the resistance hubs 610, 710 to the back legs of the frame of the exercise chair enables a user to stand on the back side of the exercise chair and perform various exercises on the back side of the chair. When the user is located on the back side the exercise chair, the user generally stands or sits on the foot rest 450 located on the back side of the exercise chair when performing various types of exercises. The weight of the user on foot rest 450 facilitates in stabilizing and/or inhibiting or preventing movement of the frame of the exercise chair when the user is performing various exercises; however, this is not required. When the user is standing on the back side of the exercise chair, the use can gasp with one or both hands one or both of back rests 280, 282 to provide some balance to the user when performing one or more exercises; however, this is not required.

As illustrated in FIGS. 9 and 10, the side sections 252, 254 of the back support each include an intermediate hub connector 1000. The size, shape, configuration and orientation of the hub connector can be the same or similar to hub connectors 270; however, this is not required. The intermediate hub connectors are illustrated as being positioned above the seat 300 when the exercise chair is in the unfolded position; however, this is not required. The two resistance arrangements 600, 700 each include intermediate resistant hubs 1100, 1102. The intermediate resistant hubs 1100, 1102 are designed to be permanently or releasably connected to the intermediate hub connectors. The intermediate resistant hubs 1100, 1102 are also designed to be swiveled on the intermediate hub connectors. Generally, the intermediate resistant hubs 1100, 1102 are also designed to swivel 30°-320° about the intermediate hub connectors, typically designed to swivel 90°-270° about the intermediate hub connectors, more typically designed to swivel 90°-230° about the intermediate hub connectors, still more typically designed to swivel 120°-230° about the intermediate hub connectors, even more typically designed to swivel 150°-200° about the intermediate hub connectors. In one non-limiting design, the intermediate resistant hubs 1100, 1102 are designed to swivel up to about 180° about the intermediate hub connectors. Generally, the intermediate resistant hubs 1100, 1102 are designed to swivel about the intermediate hub connectors a larger circular angle that the resistant hubs are connected to hub connectors 270, 272 however, this is not required. In one non-limiting design, the intermediate resistant hubs 1100, 1102 are designed to swivel up to about 180° about the intermediate hub connectors, resistant hubs 610, 710 are designed to swivel up to about 90° about the hub connectors 272 or 900, and resistant hubs 620, 720 are designed to swivel up to about 90° about the hub connectors 270.

Intermediate resistant hubs 1100, 1102 can include a groove wheel and corresponding guide roller that is the same or similar to the groove wheel and corresponding guide roller used in resistant hubs 610, 620, 710, 720; however, this is not required. Intermediate resistant hubs 1100, 1102 can include the same or similar top and bottom opening configuration in the body of the intermediate resistant hubs as used in the body of resistant hubs 610, 620, 710, 720; however, this is not required. The same or similar arrangement that is used on hub connector 270, 272, 900 and the body of resistant hubs 610, 620, 710, 720 to limit the degree of rotation of the resistant hubs on the hub connector can also be used on intermediate resistant hubs 1100, 1102 and intermediate hub connectors 1100, 1102 to limit the degree of rotation of the intermediate resistant hubs on the intermediate hub connector; however, this is not required. Generally the body of the intermediate resistant hubs 1100, 1102 is small than the body of resistant hubs 610, 620, 710, 720; however, this is not required.

As illustrated in FIG. 9, when resistant hubs 610, 710 are connected to hub connectors 272 on the front legs of the chair frame, the body of intermediate resistant hubs 1100, 1102 is facing generally forward. When resistant hubs 610, 710 are connected to hub connectors 900 on the back legs of the chair frame, the body of intermediate resistant hubs 1100, 1102 is facing generally rearwardly as illustrated in FIG. 10. The ability of the intermediate resistant hubs 1100, 1102 to rotate 180° or more on the intermediate connections hubs allows the body of the intermediate resistant hubs 1100, 1102 to be orientated as illustrated in FIGS. 9 and 10.

The use of the intermediate resistant hubs 1100, 1102 facilitates in ensuring that a similar resistance of provided by the resistance bands or cords is encountered by the user when the intermediate resistant hubs 1100, 1102 are connected to either the front or back legs of the chair frame. The intermediate resistant hubs 1100, 1102 also are used to ensure that the resistance bands or cords are maintained close to the side of the chair frame during use.

It will thus be seen that the objects set forth above, among those made apparent from the preceding description, are efficiently attained, and since certain changes may be made in the constructions set forth without departing from the spirit and scope of the invention, it is intended that all matter contained in the above description and shown in the accompanying drawings shall be interpreted as illustrative and not in a limiting sense. The invention has been described with reference to preferred and alternate embodiments. Modifications and alterations will become apparent to those skilled in the art upon reading and understanding the detailed discussion of the invention provided herein. This invention is intended to include all such modifications and alterations insofar as they come within the scope of the present invention. It is also to be understood that the following claims are intended to cover all of the generic and specific features of the invention herein described and all statements of the scope of the invention, which, as a matter of language, might be said to fall therebetween. The invention has been described with reference to the preferred embodiments. These and other modifications of the preferred embodiments as well as other embodiments of the invention will be obvious from the disclosure herein, whereby the foregoing descriptive matter is to be interpreted merely as illustrative of the invention and not as a limitation. It is intended to include all such modifications and alterations insofar as they come within the scope of the appended claims.

I claim:

1. A portable exercise chair including a chair frame, a chair seat and a resistance system, said chair frame including an upper back portion and a lower leg portion, said resistance system including a first and second resistance arrangements, each of said resistance arrangements including first and second resistance hubs and a stretchable resistance member, said first resistance hub on said first resistance arrangement releasably and swivelly connectable to a first side of said upper back portion, said first resistance hub on said second resistance arrangement releasably and swivelly connectable to a second side of said upper back portion, said second resistance hub on said first resistance arrangement releasably and swivelly connectable to a first side of said lower leg portion, said second resistance hub on said second resistance arrangement releasably and swivelly connectable to a second side of said lower leg portion, said stretchable resistance member of said first resistance arrangement engaging said first and second resistance hubs of said first resistance arrangement, said stretchable resistance member of said second resistance arrangement engaging said first and second resistance hubs of said second resistance arrangement, each of said stretchable resistance member includes first and second ends, said first and second ends each including a resistance member connector, each of said first and second resistance hubs of said first resistance arrangement including a top surface having a top opening, a bottom surface having a bottom opening and hub passageway connected to said top and bottom openings, said bottom surface of said first resistance hub facing downwardly when said first resistance hub is connected to said chair frame, said bottom surface of said second resistance hub facing upwardly when said second resistance hub is connected to said chair frame, said resistance member connector on said first end of said stretchable resistance member having a size so as to not be able to fully pass through said top opening and hub passageway of said first resistance hub, said resistance member connector on said second end of said stretchable resistance member having a size so as to not be able to fully pass through said top opening and hub passageway of said second resistance hub, said resistance member connector configured to be connected to one or more exercise devices that include devices selected from the group consisting of hand handle, foot handle, foot connector, ankle connector, hand connector, ankle connector, and connector strap, said chair frame being a foldable frame, said lower leg portion of said chair frame including two front legs and two rear legs, and including a foot rest arrangement pivotally connected to said two front legs, said two rear legs, or both said two front legs and said two rear legs, said chair seat being pivotally connected to said two front legs, said two rear legs, or both said two front legs and said two rear legs, a raise rod connected between said foot rest arrangement and said chair seat so that said foot rest arrangement and said chair seat fold at the same time when the foldable frame is folded, said chair frame including two upwardly extending L-shaped hub connectors on said upper back portion each for removably receiving a respective one of said first resistance hubs, and two downwardly extending L-shaped hub connectors on said lower leg portion each for removably receiving a respective one of said second resistance hubs, said hub connectors having a rotation limitation arrangement that limits the degree at which each resistance hub swivels on said hub connectors.

2. The portable exercise chair as defined in claim 1, wherein said foot rest arrangement includes first and second foot rests, said first foot rest pivotally attached to said two front legs, said second foot rest pivotally attached to said two rear legs.

3. The portable exercise chair as defined in claim 1, wherein each of said first and second resistance hubs on said first and second resistance arrangements include a plurality of rollers, at least one of said rollers includes a groove to guide said stretchable resistance member as at least a portion of said stretchable resistance member moves though said hub passageway of said first and second resistance hubs.

4. The portable exercise chair as defined in claim 1, wherein said chair frame includes two hub connectors on said upper back portion and four hub connectors on said lower leg portion, one of said hub connectors on said lower leg portion connected to each of said four legs, each of said hub connectors having a similar shape, said hub connector having a rotation limitation arrangement that limits the degree at which said resistance hubs swivel on said hub connectors.

5. The portable exercise chair as defined in claim 4, including two intermediate hub connectors connectable to said chair seat, said chair frame, or combinations thereof, said first and second resistance arrangements each including an intermediate resistance hub that is designed to releasably and swivelly connectable to one of said intermediate hub connectors.

6. The portable exercise chair as defined in claim 5, wherein each of said intermediate hubs on said first and second resistance arrangements include a plurality of rollers, at least one of said rollers includes a groove to guide said stretchable resistance member as at least a portion of said stretchable resistance member moves though said hub passageway of said first and second resistance hubs.

7. The portable exercise chair as defined in claim 1, wherein said upper back portion includes a pair of back bars designed to support a back of a user sitting in said chair seat, each of said back bars including a compressible material.

8. The portable exercise chair as defined in claim 1, wherein said chair seat includes a detachable swivel platform that enables a user to swivel in said chair seat when seated in said chair seat.

9. A portable exercise chair including a chair frame, a chair seat and a resistance system, said chair frame including an upper back portion and a lower leg portion, said chair frame is a foldable frame, said lower leg portion of said chair frame including two front legs and two rear legs, and including a foot rest arrangement pivotally connected to said two front legs, said two rear legs, or both said two front legs and said two rear legs, said chair seat being pivotally connected to said two front legs, said two rear legs, or both said two front legs and said two rear legs, a raise rod connected between said foot rest arrangement and said chair seat so that when said foldable frame is folded, said foot rest arrangement and said chair seat fold at the same time, said resistance system including a first and second resistance arrangements, each of said resistance arrangements including first and second resistance hubs, an intermediate resistance hub, and a stretchable resistance member, said first resistance hub on said first resistance arrangement releasably and swivelly connectable to a first side of said upper back portion, said first resistance hub on said second resistance arrangement releasably and swivelly connectable to a second side of said upper back portion, said second resistance hub on said first resistance arrangement releasably and swivelly connectable to said front leg or rear leg on a first side of said lower leg portion, said second resistance hub on said second resistance arrangement releasably and swivelly connectable to said front leg or rear leg on a second side of said lower leg portion, said intermediate hub hubs on each of said resistance arrangements being releasably and swivelly connectable to said chair seat, said chair frame, or combinations thereof, said chair frame including two upwardly extending L-shaped hub connectors on said upper back portion, two downwardly extending L-shaped hub connectors on said front legs of said lower leg portion, two downwardly extending L-shaped hub connectors on said rear legs of said lower leg portion, and two intermediate hub connectors connected to said chair seat, said chair frame, or combinations thereof, each of said hub connectors on said upper back portion and said rear and from legs of said lower leg portion having a rotation limitation arrangement that limits the degree at which said resistance hubs swivel on said hub connectors, said stretchable resistance member of said first resistance arrangement engaging said first and second resistance hubs and said intermediate resistance hub of said first resistance arrangement, said stretchable resistance member of said second resistance arrangement engaging said first and second resistance hubs and said intermediate resistance hub of said second resistance arrangement, each of said stretchable resistance member includes first and second ends, said first and second ends each including a resistance member connector, each of said first and second resistance hubs of said first resistance arrangement including a top surface having a top opening, a bottom surface having a bottom opening and hub passageway connected to said top and bottom openings, said bottom surface of said first resistance hub facing downwardly when said first resistance hub is connected to said chair frame, said bottom surface of said second resistance hub facing upwardly when said second resistance hub is connected to said chair frame, said resistance member connector on said first end of said stretchable resistance member having a size so as to not be able to fully pass through said top opening and hub passageway of said first resistance hub, said resistance member connector on said second end of said stretchable resistance member having a size so as to not be able to fully pass through said top opening and hub passageway of said second resistance hub, said resistance member connector configured to be connected to one or more exercise devices that include devices selected from the group consisting of hand handle, foot handle, foot connector, ankle connector, hand connector, ankle connector, and connector strap.

10. The portable exercise chair as defined in claim 9, wherein said foot rest arrangement includes first and second foot rests, said first foot rest pivotally attached to said two front legs, said second foot rest pivotally attached to said two rear legs.

11. The portable exercise chair as defined in claim 9, wherein each of said first and second resistance hubs and said intermediate resistance hub on said first and second resistance arrangements include a plurality of rollers, at least one of said rollers of said first and second resistance hubs includes a groove to guide said stretchable resistance member as at least a portion of said stretchable resistance member moves though said hub passageway of said first and second resistance hubs.

12. The portable exercise chair as defined in claim 9, wherein said upper back portion includes a pair of back bars designed to support a back of a user sitting in said chair seat, each of said back bars including a compressible material.

13. The portable exercise chair as defined in claim 9, wherein said chair seat includes a detachable swivel platform that enables a user to swivel in said chair seat when seated in said chair seat.

* * * * *